US006325140B1

(12) United States Patent
Na et al.

(10) Patent No.: US 6,325,140 B1
(45) Date of Patent: Dec. 4, 2001

(54) FIN AND TUBE TYPE HEAT EXCHANGER

(75) Inventors: Byeong Chul Na, Seoul; Dae Hyun Jin, Kyonggi-do, both of (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/645,452

(22) Filed: Aug. 25, 2000

(30) Foreign Application Priority Data

Dec. 13, 1999 (KR) ..... 99-57160

(51) Int. Cl.[7] ..... F28D 1/04; F28F 1/30
(52) U.S. Cl. ..... 165/151; 165/182
(58) Field of Search ..... 165/151, 182, 165/910

(56) References Cited

U.S. PATENT DOCUMENTS 4,723,600 * 2/1988 Yokoyama et al. ..... 165/151
5,170,842 * 12/1992 Kato et al. ..... 165/151
5,706,885 * 1/1998 Kim ..... 165/151
5,975,198 * 11/1999 Kim et al. ..... 165/151
6,227,289 * 5/2001 Yokoyama et al. ..... 165/151

* cited by examiner

*Primary Examiner*—Ira S. Lazarus
*Assistant Examiner*—Tho Van Duong
(74) *Attorney, Agent, or Firm*—Birch, Stewart, Kolasch & Birch, LLP

(57) ABSTRACT

Fin tube heat exchanger including heat exchange tubes each having an inside for flow of fluid therethrough, and sheets of cooling fins stacked at fixed intervals each having the heat exchange tubes passed therethrough in a row pitch $L_2$, a direction along an air flow, in a range of $1.8\ D_0 \leqq L_2 \leqq 2.2\ D_0$ and in a step pitch $S_2$, a direction perpendicular to the air flow, in a range of $3.3\ D_0 \leqq S_2 \leqq 4.5\ D_0$, where $D_0$ denotes a diameter of the heat exchange tube, and projection pieces between the tubes opened for the air flow, thereby reducing a power consumption, noise, to improve reliability of the user, and saving production cost and making the heat exchanger compact.

1 Claim, 4 Drawing Sheets

FIN AND TUBE TYPE HEAT EXCHANGER

BACKGROUND OF THE INVENTION

1. Field of the Invention

The present invention relates to a fin and tube type heat exchanger, and more particularly, to a fin tube heat exchanger of a compact type, for reducing a production cost, enhancing a heat exchange efficiency compared to a related art heat exchanger, and reducing power consumption of a motor coming from a pressure loss.

2. Background of the Related Art

FIGS. 1 and 2 illustrate fin tube type heat exchangers. The fin tube type heat exchanger is provided with a plurality of fins stacked perpendicular to heat exchange tubes 10, to enlarge a heat exchange surface for enhancing a heat exchange effect. There are a plurality of coupling holes 21 in a surface of the fin along a long side direction of the cooling fins 20, through which the heat exchange tubes 10 are passed. The coupling holes are formed in two rows in zigzag in an upper step and in a lower step of the cooling fins. A space between adjacent coupling holes 21 on the same step is opened for an air flow(a short side direction of the cooling fin), and the space has a plurality of projections 22 formed reciprocally in a front and a rear surfaces thereof for guiding the air flow that passes respective cooling fins. Therefore, the refrigerant flowing in from a refrigerant inlet of the heat exchange tubes 10 passes inside of the heat exchange tubes, to cool down the heat exchange tube 10 and drop a temperature of the heat exchange tubes, and, on the same time with this, a heat source (air) provided from outside of the heat exchanger is passed between the cooling fins 20 by rotation of a fan(not shown), so that the air passed between respective cooling fins makes heat exchange with the refrigerant through the heat exchange tubes 10, the cooling fins 20 and the projections 22. And, the turbulence caused by the projections 22 as the air hits onto the projections 22 during the air passes through openings of the projections 22 enhances the heat exchange effect.

In the meantime, design criteria of the aforementioned related art heat exchanger are fixed to maximize the heat exchange efficiency. Taking the fact that a thermal resistance on a side external air flows is higher than a thermal resistance inside of the heat exchange tube into account, a difference of the thermal resistances can be reduced by enlarging a heat exchange surface on the side the external air flows. For this, a center distance between adjacent coupling holes 21 on the same row in the cooling fin 20 (called as "step pitch S") is set in terms of the tube diameter $D_0$ to be $2.5\ D_0 \leqq S_1 \leqq 3.0\ D_0$and a width of the cooling fin 20(or a distance between adjacent steps when the cooling fin has at least two steps of the coupling holes)(called as "row pitch $L_1$, ") is set in terms of the tube diameter $D_0$ to be $1.2\ D_0 \leqq L_1 \leqq 1.8\ D_0$. Considering that generally used diameters of the tube 10 are 9.52 mm or 7 mm, the heat exchanger with the tube diameter $D_0$9.52 mm is designed to have the step pitch $S_1$ to be within a range of 2.5~2.7 $D_0$and the row pitch $L_1$ to be in a range of 1.8 $D_0$. And, the heat exchanger with the tube diameter $D_0$ 7 mm is designed to have the step pitch $S_1$ to be in a range of 3 $D_0$and the row pitch $L_1$ to be in a range of 1.2 $D_0$. As the foregoing configurations of the heat exchanger has small ranges of the step pitches $S_1$ and the row pitches $L_1$, compared to the tube diameters $D_0$, an improvement of the heat exchange performance can be achieved when an air flow rate is the same.

However, the small ranges cause a higher pressure loss on the air side. That is, the high air flow speed required for the improvement of the heat exchange performance causes an increased noise, but a configuration of the tubes designed to reduce the noise drops the heat exchange performance. Because a power of a fan motor (not shown) should be increased for obtaining the same air flow rate in a state the pressure loss on the air side is increased, a power consumption can not, but be increased, and damage to the fan motor can be caused.

SUMMARY OF THE INVENTION

Accordingly, the present invention is directed to a fin tube heat exchanger that substantially obviates one or more of the problems due to limitations and disadvantages of the related art.

An object of the present invention is to provide a fin tube heat exchanger which has an optimal design that can prevent an air side pressure loss, maintain a hest exchange performance to an appropriate state, reduce a heat exchanger maintenance cost, and save an overall heat exchanger fabrication cost.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the fin tube heat exchanger includes heat exchange tubes each having an inside for flow of fluid therethrough, and sheets of cooling fins stacked at fixed intervals each having the heat exchange tubes passed therethrough in a step pitch $L_2$, a direction along an air flow, in a range of $1.8\ D_0 \leqq L_2 \leqq 2.2\ D_0$and in a row pitch $S_2$, a direction perpendicular to the air flow, in a range of $3.3\ D_0 \leqq S_2 \leqq 4.5\ D_0$, where $D_0$denotes a diameter of the heat exchange tube, and protection pieces between the tubes opened for the air flow.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
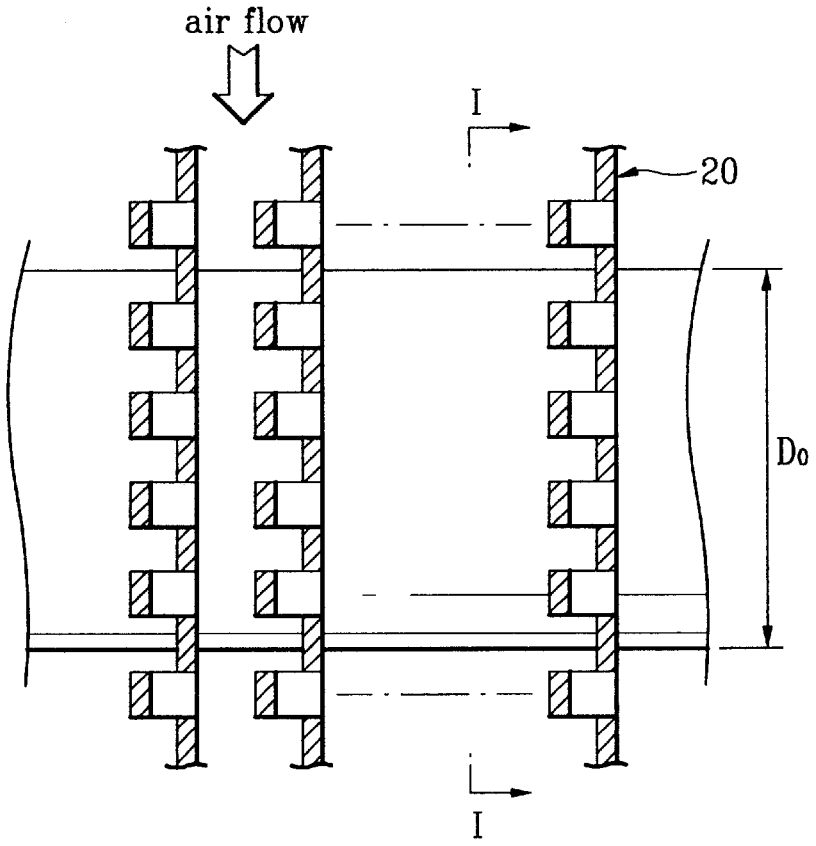
FIG.1 Related Art
FIG. 1 illustrates a section showing a key part of a related art fin-tube type heat exchanger.
Figure 2:
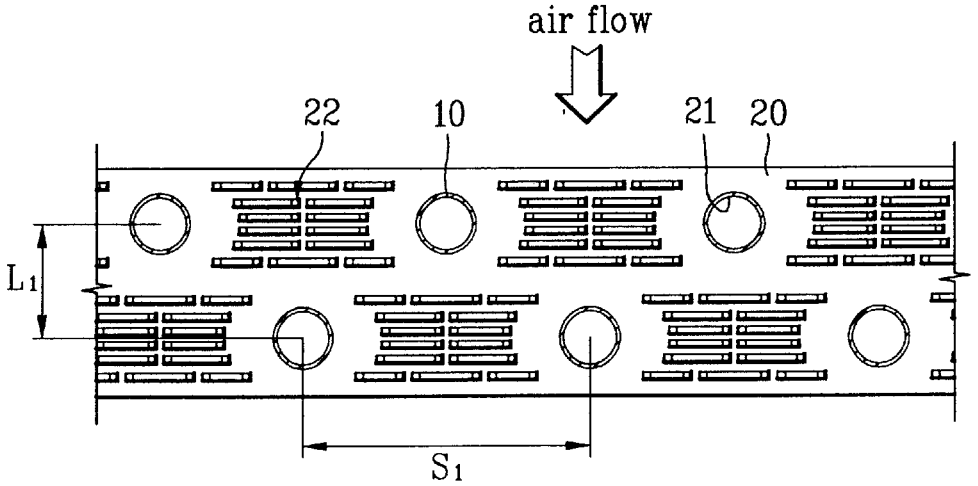
FIG.2 Related Art
FIG. 2 illustrates a section across line I—I.
Figure 3:
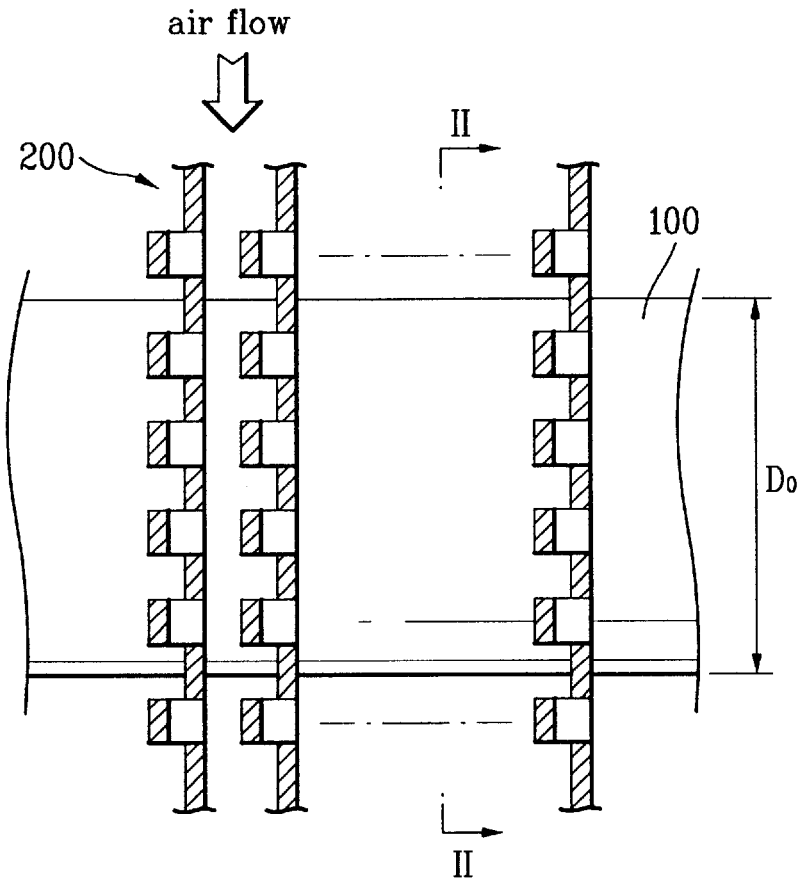
FIG. 3 illustrates a section showing a key part of a fin-tube type heat exchanger in accordance with a preferred embodiment of the present invention.
Figure 4:
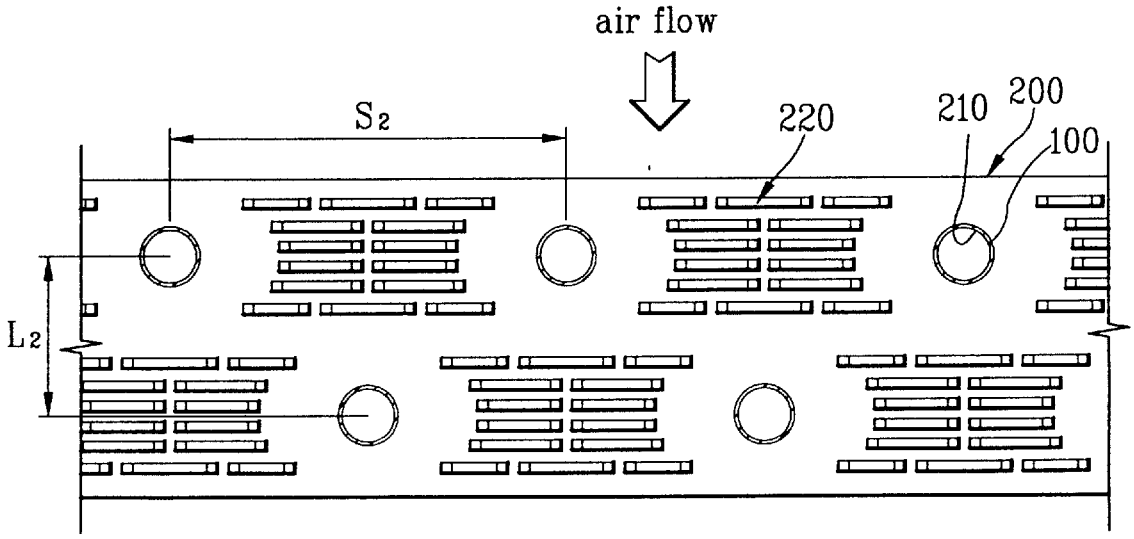
FIG. 4 illustrates a section across line II—II.
Figure 5A:
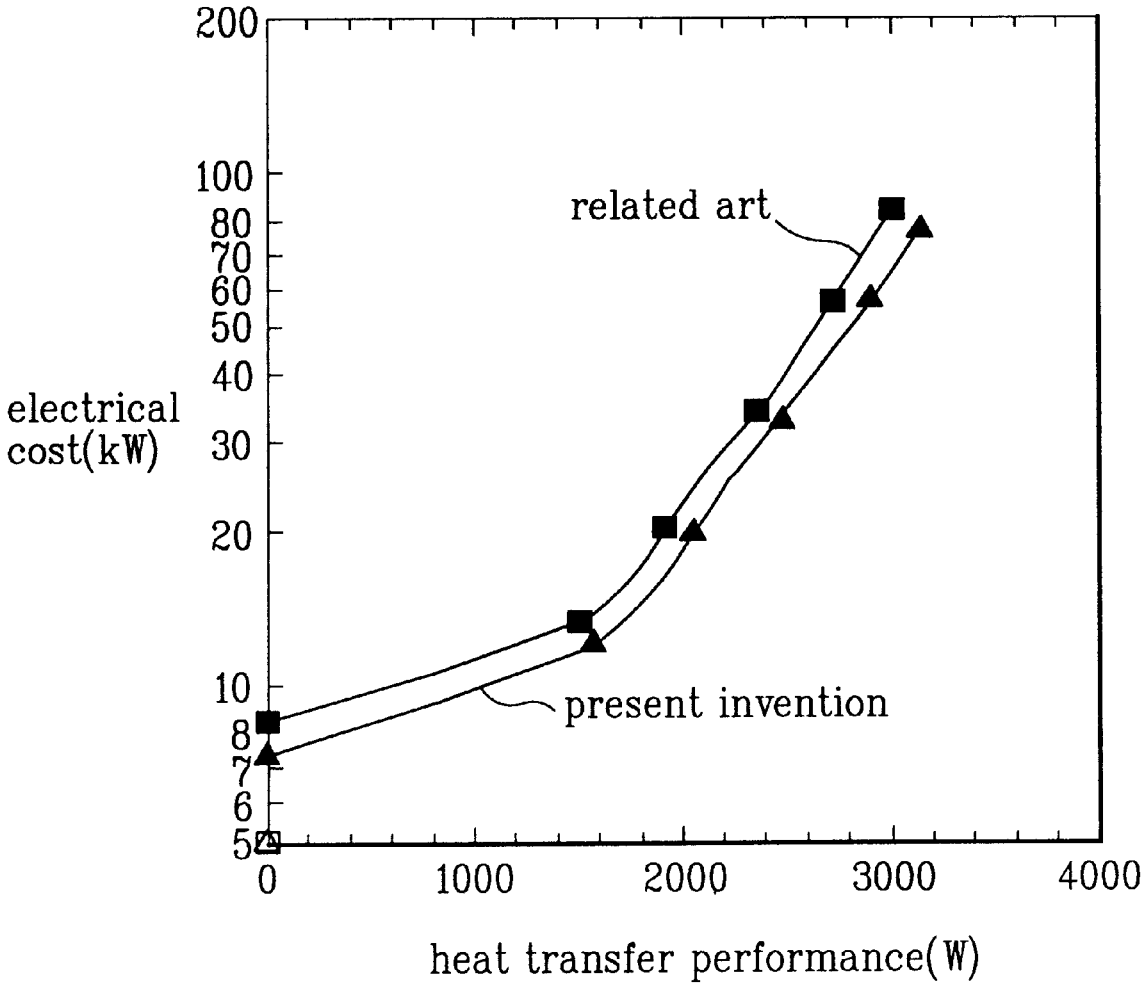
FIG. 5A illustrates a graph showing power consumption vs. heat transfer performance as a comparison of the heat exchangers of the present invention and the related art; and, FIG. 5B illustrates a graph showing noise vs. heat transfer performance as a comparison of the heat exchangers of the present invention and the related art.
Figure 5B:
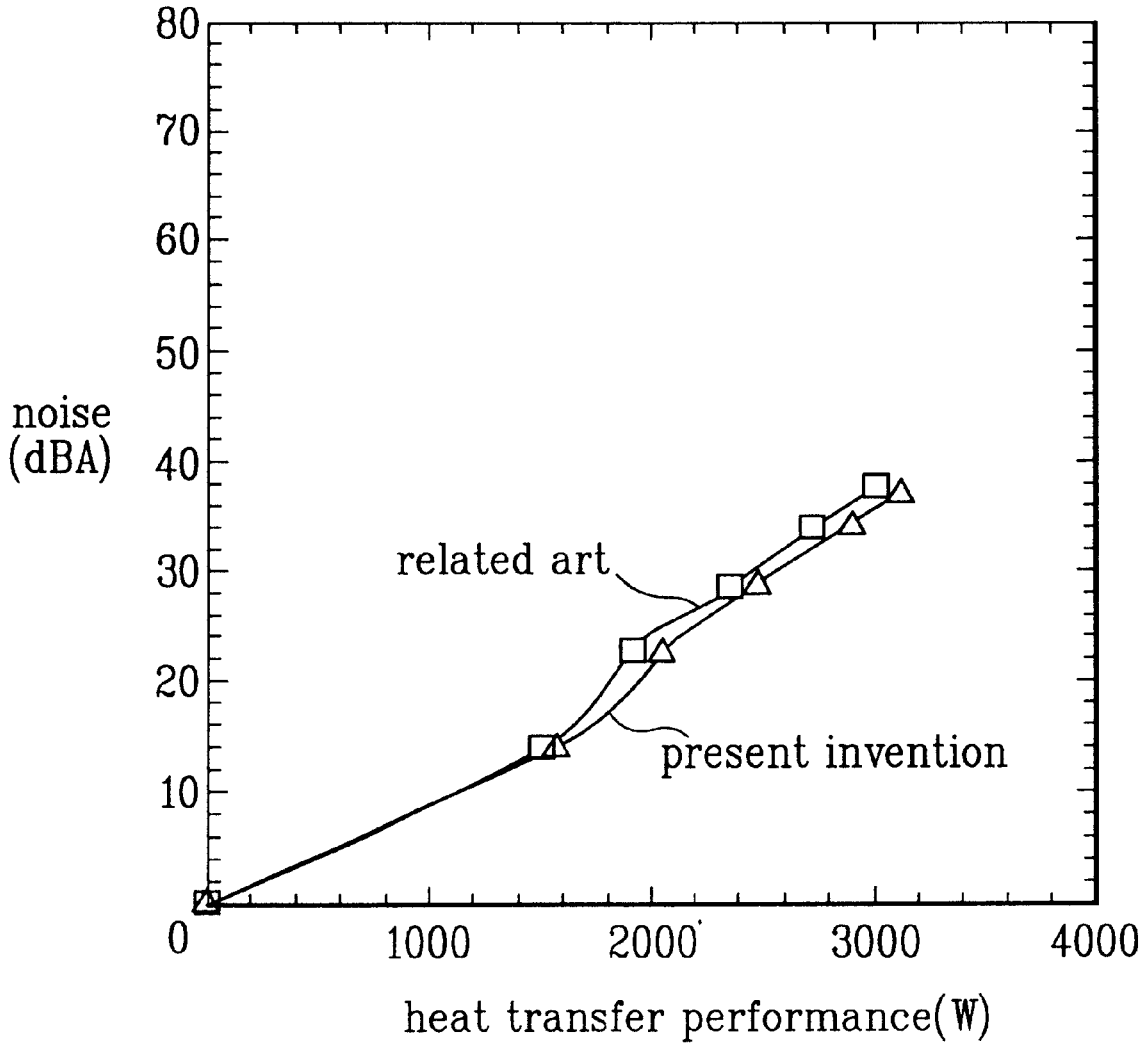

Reference will now be made in detail to the preferred embodiments of the present invention, examples of which are illustrated in the accompanying drawings. FIG. 3 illustrates a section showing a key part of a fin-tube type heat exchanger in accordance with a preferred embodiment of the present invention, FIG. 4 illustrates a section across line II—II, FIG. 5A illustrates a graph showing power consumption vs. heat transfer performance as a comparison of the heat exchangers of the present invention and the related art, and FIG. 5B illustrates a graph showing noise vs. heat transfer performance as a comparison of the heat exchangers of the present invention and the related art.

The present invention takes the fact into account that an important factor for controlling a heat transfer performance is a distance between tubes 100 passed through the cooling fins 200. That is, though the smaller the distance between the tubes 100, the better the heat transfer performance, but with the greater the pressure loss coming from air flow. And, contrary to this, though the greater the distance between the tubes 100, the smaller the pressure loss coming from air flow, but with the worse the heat transfer performance. Considering the above, in the present invention, the distance between the tubes 100 is adjusted appropriately, to keep a heat transfer performance constant while the pressure loss is reduced.

In order to achieve the above, the heat exchanger of the present invention is designed as follows.

That is, a width of the cooling fin 20, or a distance between adjacent steps when the cooling fin has at least two steps of the coupling holes with reference to a direction of the air flow, i.e., the row pitch $L_2$ is set in terms of the tube diameter $D_0$ to be $1.8\ D_0 \leqq L_2 2.2\ D_0$. And, a width of the cooling fin 200, or a center distance between adjacent tubes 100 on the same step perpendicular to a direction of air flow, i.e., step pitch $S_2$, is set in terms of the tube diameter $D_0$ to be $3.3\ D_0 \leqq S_2 \leqq 4.5\ D_0$. There are projection pieces 220 on a surface of the cooling fin 200 between the tubes opened to the direction of air flow.

The effect of the aforementioned fin tube type heat exchanger of the present invention will be explained with reference to FIGS. 5A and 5B.

Referring to FIG. 5A, a power cost for fan driving based on approx. 2000w heat exchange is approx. 2400won in the related art, and is approx. 2000won in the present invention. It can be noted that the better the heat transfer performance, the greater the difference of the power costs.

Referring to FIG. 5B, a noise caused by air flow between respective cooling fins 200 based on the same heat exchange performance(approx. 2000w) is approx. 21dBA in the related art, and approx. 24.4dBA in the present invention. It can be noted that the better the heat transfer performance, the greater the difference of the noises. Thus, it is possible that the heat exchanger of the present invention can also reduce the noise.

In conclusion, the row pitch $L_2$ in a range of $1.8\ D_0 \leqq L_2 \leqq 2.2\ D_0$, and the step pitch $S_2$ in a range of $3.3\ D_0 \leqq S_2 \leqq 4.5\ D_0$ provide an optimal fin tube type heat exchanger. The row pitch $L_2$ and/or the step pitch $S_2$ falling outside of the above ranges will provide the heat exchanger inferior to the heat exchanger of the present invention in view of the heat exchange performance, the power consumption, and the noise levels.

As has been explained, the fin tube heat exchanger of the present invention has the following advantages.

By adjusting distances between rows and steps of the heat exchange tubes to an optimal state, the heat exchange performance can be made similar to improved from the related art while a pressure loss is reduced, that in turn reduces a power consumption as well as noise, to improve reliability of the user.

The reduction of the heat exchange tubes required for fabrication of the heat exchanger allows saving in production cost and to make the heat exchanger compact.

It will be apparent to those skilled in the art that various modifications and variations can be made in the fin tube heat exchanger of the present invention without departing from the spirit or scope of the invention. Thus, it is intended that the present invention cover the modifications and variations of this invention provided they come within the scope of the appended claims and their equivalents.

What is claimed is:

1. A fin tube heat exchanger comprising:

heat exchange tubes each having an inside for flow of fluid therethrough; and sheets of cooling fins stacked at fixed intervals each having the heat exchange tubes passed therethrough in a row pitch $L_2$, a direction along an air flow, in a range of $1.8\ D_0 < L_2 \leqq 2.2\ D_0$ and in a step pitch $S_2$, a direction perpendicular to the air flow, in a range of $3.3\ D_0 < S_2 \leqq 4.5\ D_0$, where $D_0$ denotes a diameter of the heat exchange tube, and projection pieces between the tubes opened for the air flow.

* * * * *